United States Patent [19]

McLean

[11] 4,337,864

[45] Jul. 6, 1982

[54] CURRENCY NOTE DISPENSING SYSTEM

[75] Inventor: Charles M. McLean, Richardson, Tex.

[73] Assignee: Docutel Corporation, Irving, Tex.

[21] Appl. No.: 123,642

[22] Filed: Feb. 22, 1980

[51] Int. Cl.[3] ..... B07C 5/00

[52] U.S. Cl. ..... 209/534; 209/551; 209/909; 194/4 R; 194/DIG. 26; 221/71; 221/197; 235/92 SB; 271/8 R; 271/207; 242/67.3 R

[58] Field of Search ..... 194/4 R, 4 B–4 E, 194/DIG. 26; 133/1; 235/379, 381, 92 SB; 271/8, 207; 209/534, 909; 242/67.3, 67.2; 221/71, 73, 197, 3, 4

[56] References Cited

U.S. PATENT DOCUMENTS

| | | | |
|---|---|---|---|
| 1,953,073 | 4/1934 | Chiger | 133/1 |
| 2,009,385 | 7/1935 | Chiger | 133/1 |
| 2,687,135 | 8/1954 | Heim | 133/1 |
| 2,981,492 | 4/1961 | Simjian | 242/67.3 |
| 3,026,023 | 3/1962 | Hirschfeld | 194/DIG. 26 |
| 3,038,157 | 6/1962 | Simjian | 194/4 |
| 3,039,582 | 6/1962 | Simjian | 194/4 |
| 3,072,237 | 6/1963 | Simjian | 194/4 |
| 3,193,283 | 7/1965 | Smith | 271/3 |
| 3,222,057 | 12/1965 | Couri | 194/DIG. 26 |
| 3,442,363 | 5/1969 | Riddle et al. | 194/4 |
| 3,447,655 | 6/1969 | Tanaka et al. | 194/DIG. 26 |
| 3,683,943 | 8/1972 | DeCrepy | 194/4 R |

*Primary Examiner*—Allen N. Knowles

*Attorney, Agent, or Firm*—Richards, Harris & Medlock

[57] ABSTRACT

Two embodiments of a system for dispensing currency notes are disclosed. The first embodiment of the system comprises two major components, a cartridge (10) and a dispenser (14). The second embodiment of the system comprises three major components, a cartridge (10), a loader (12) and a dispenser (14). The cartridge (10) comprises a housing (28) having a supply spool (30) and two takeup spools (32, 34) rotatably mounted therein. Outer and inner flexible films (36, 38) are secured to and wound about the spools. Individual currency notes (18) are sandwiched between the films (36, 38) and stored on the supply spool (30). The loader (12) separates and verifies individual currency notes from a stack and transports the currency notes to the cartridge (10). The loader (12) causes the supply spool (30) to rotate so that an individual currency note is stored on the spool and further resists the rotation of the takeup spools (32, 34) to maintain tension in the films (36, 38). The cartridge (10) is removed from the loader (12) and transported to a remote dispenser (16). The cartridge (10) is inserted into the dispenser (16). Activation of the dispenser (16) causes rotation of the takeup spools (32, 34) and a resistance to rotation of the supply spool (30) which dispenses an individual currency note. The first embodiment of the system provides the advantage of permitting a number of cartridges (10) to be interchangeably used with a number of dispensers (14). The second embodiment of the system provides the advantage of permitting the cartridge (10) to be adapted for use with both the loader (12) and dispenser (16) and thereby permits a single loader (12) to serve many dispensers (16).

23 Claims, 6 Drawing Figures

CURRENCY NOTE DISPENSING SYSTEM

TECHNICAL FIELD

This invention relates to a system for dispensing currency notes, and more particularly to a system for dispensing currency notes comprising a dispenser and a cartridge for storing currency notes and which may further comprise a loader.

BACKGROUND ART

The use of automated teller machines (ATM) has become prevalent in the last several years. A customer using an ATM will typically have a card or token with an identifying numerical sequence thereon that is inserted into the ATM, permitting the customer to deposit or withdraw funds from a bank account without interacting with a human teller. One substantial advantage of the ATM is the capability to transact bank business outside normal banking hours. A typical ATM will include a mechanism to dispense currency notes stored within the ATM in response to a customer's request. In order to maintain an accurate record of the customer's account, the ATM is also provided with a mechanism to detect and count currency notes dispensed.

In the past, currency notes, or other articles to be distributed individually have been stored on reels or spools between wrappings of a belt or tape in a cartridge. Typical cartridges are described and claimed in U.S. Pat. Nos. 2,687,135 issued to Heim on Aug. 24, 1954 and entitled "Storage Device" and 2,981,492 issued to Simjian on April 25, 1961 and entitled "Receptacle for Depository Apparatus".

It is known to employ self contained cartridges similar to those described above in a dispenser having a mechanism to detect and count the currency notes dispensed. Typical dispensing devices of this type are described and claimed in U.S. Pat. Nos. 3,038,157 issued to Simjian on June 5, 1962 and entitled "Deposit Exchange Machine Including Image Recording Means", 3,039,582 issued to Simjian on June 19, 1962 and entitled "Subscriber Controlled Apparatus" and 3,072,237 issued to Simjian on Jan. 8, 1963 and entitled "Currency Exchange Apparatus".

Such prior art cartridges must be loaded with a quantity of single currency notes. Each note is stored at a discrete location on the reel or spool so that they may be dispensed individually. A dispenser must then withdraw individual currency notes from the cartridge to dispense the currency notes as desired. The dispenser must further detect and count the currency notes being dispensed. A need exists for a system employing a cartridge for storing currency notes and a dispenser for dispensing the currency notes therefrom at a reasonable cost and with high reliability.

Since currency notes are typically packaged in a bundle or stack, some method must be employed to separate the stack into individual notes at a reasonable cost. Devices are known which may separate individual currency notes from a stack. However, these devices are too complex and expensive to be provided at each dispenser. A need has thus arisen for a system further employing a device to separate a stack into individual currency notes for storage within a cartridge until dispensed individually by a dispenser at a reasonable cost and with high reliability.

DISCLOSURE OF THE INVENTION

In accordance with the present invention, a system for dispensing currency notes is provided.

The system includes a cartridge for receiving a predetermined number of individual currency notes comprising a supply spool mounted for rotation therein, at least one takeup spool mounted for rotation therein and at least one film secured at opposite ends to the supply spool and the takeup spool and wound about the spools. The individual currency notes are received in the cartridge, placed on the film and wound about the supply spool for storage. The system further includes a dispenser for dispensing currency notes individually from the cartridge and comprising means for rotating the takeup spool to unwind the film from the supply spool and present a currency note stored within the cartridge to the dispenser, means resisting the rotation of the supply spool to maintain a preselected tension on the film, a transport mechanism for transporting the currency note through the dispenser to a customer receiving area, means sensing the presence of a currency note within the dispenser and verifying passage of the currency note through the dispenser and means controlling the rotating means, the resisting means and the transport mechanism to dispense a preselected number of currency notes to the customer receiving area.

In accordance with another aspect of the present invention, the system includes a cartridge for receiving a predetermined number of currency notes. The system further includes a loader for accepting a quantity of currency notes to be dispensed and loading the predetermined number of currency notes into the cartridge. At least one dispenser is provided for dispensing currency notes individually from the cartridge. The cartridge is adapted for use in both the loader and dispenser.

In accordance with yet another aspect of the present invention, a method for dispensing currency notes is provided. The method includes the steps of providing a cartridge for receiving a predetermined number of currency notes and loading the cartridge with the predetermined number of currency notes with a loader having a quantity of currency notes. The method further includes the steps of dispensing the currency notes individually from the cartridge in a dispenser and adapting the cartridge for use in both the loader and dispenser.

BRIEF DESCRIPTION OF DRAWINGS

A more complete understanding of the invention and its advantages will be apparent from the following Detailed Description taken in conjunction with the accompanying Drawings in which.

DETAILED DESCRIPTION

Figure 1:
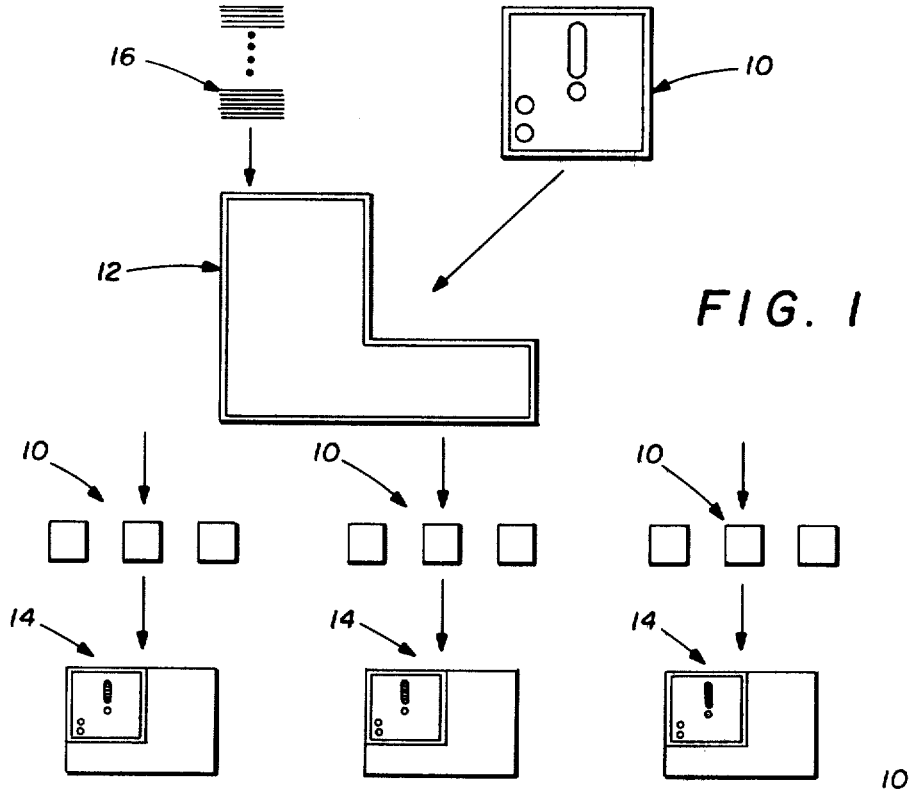
FIG. 1 illustrates the two embodiments of the currency note dispensing system forming the present invention.

FIG. 1 illustrates the two embodiments of the currency note dispensing system of the present invention. The first embodiment of the system includes a number of interchangeable cartridges 10 for storing currency notes within and a number of dispensers 14 at desired locations for dispensing currency notes individually from a cartridge 10. The second embodiment of the system further includes a loader 12 for loading currency notes into cartridges 10. A stack of currency notes 16 is placed within loader 12. Loader 12 separates and verifies individual currency notes for loading into cartridge 10.

In the system including cartridge 10 and dispenser 14, the dispensing of individual currency notes is performed at low cost and with high reliability. In the system including cartridge 10, dispenser 14 and loader 12, the task of separating and verifying individual currency notes 18 from a stack 16 is a difficult task. The currency notes 18 may vary greatly in quality, resulting from the various degrees of wear and tear found in circulating currency notes. The loader 12 is therefore a complex and expensive mechanism. The dispenser 14, on the other hand, performs a relatively simple function of counting and dispensing individual currency notes. By providing a cartridge 10 which is adapted for use with both loader 12 and a dispenser 14, one loader 12 may be used to provide a large number of dispensers 14 with individually stored currency notes. By designing the cartridge 10 to be a closed unit, the cartridge forms a secure and convenient means for transporting currency notes from the loader 12 to a dispenser 14. By controlling the number of currency notes loaded into a cartridge 10, the cartridge may also form a method of accounting for currency notes. Both embodiments of the system therefore result in a high reliability and low cost technique for dispensing currency notes.

Figure 2:
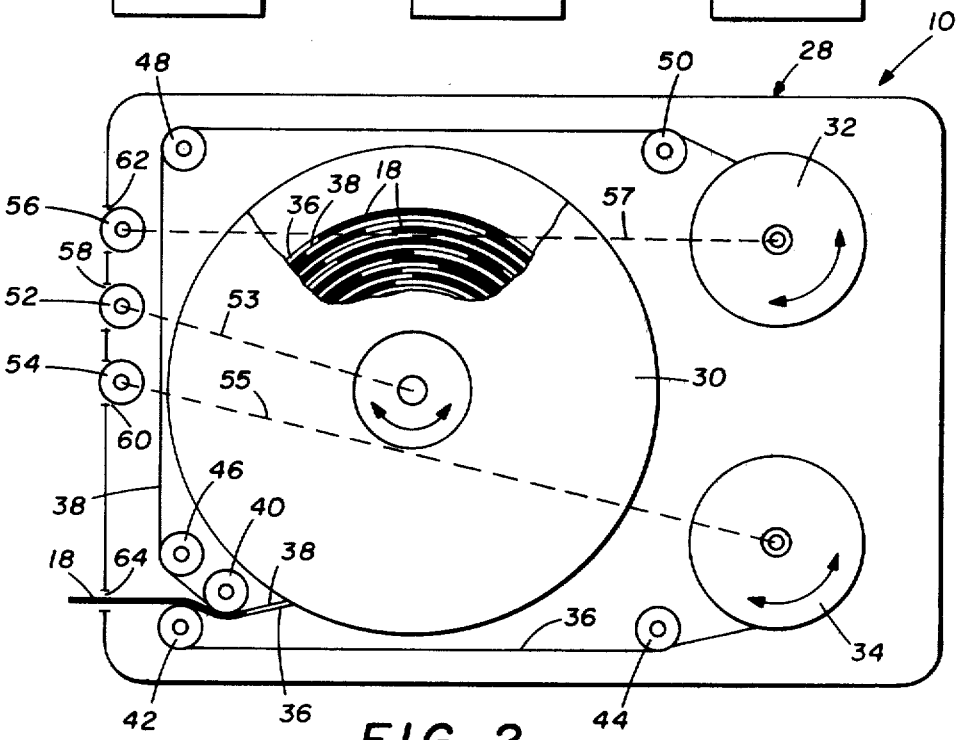
FIG. 2 is a sectional view of the cartridge employed in the present invention.

FIG. 2 illustrates the cartridge 10 in greater detail. A generally continuous housing 28 defines the outer surface of cartridge 10. Although housing 28 may comprise two half portions secured together so that members described hereinafter may be placed within housing 28, it will be understood that in normal use housing 28 will be an integral structure that will resist any reasonable attempt to obtain the currency notes therein in a manner other than provided by the present invention. This integral structure may be formed by locking the various portions of the cartridge together.

A supply spool 30, inner film takeup spool 32 and outer film takeup spool 34 are rotatably mounted within housing 28. An outer film 36 and an inner film 38 are both secured at one end to supply spool 30 and at the opposite end to outer film takeup spool 34 and inner film takeup spool 32, respectively, and wound about the spools. Films 36 and 38 may be formed of a flexible plastic, for example that marketed under the trademark Mylar.

Outer film 36 is threaded past roller 40, about outer film feed roller 42 and by idler roller 44 between supply spool 30 and outer film takeup spool 34. Inner film 38 is threaded by roller 40, inner film feed roller 46, idler roller 48 and idler roller 50 between supply spool 30 and inner film takeup spool 32. Feed rollers 42 and 46 may be synchronized for common counter-rotation if desired.

A supply spool interface roller 52 is rotatably mounted within housing 28 adjacent one side of the cartridge 10 as shown. Supply spool interface roller 52 is mechanically linked to supply spool 30 so that rotation of one member will induce a similarly directed rotation in the other. The mechanical link may take the form of a belt interconnecting pulleys mounted on interface roller 52 and supply spool 30, although any other suitable mechanism providing common rotation would be sufficient. An outer film takeup spool interface roller 54 is similarly mounted for rotation within housing 28 and is mechanically linked to outer film takeup spool 34 for common rotation. An inner film takeup spool interface roller 56 is similarly rotatably mounted within housing 28 and mechanically linked to inner film takeup spool 32. Spool interface apertures 58, 60 and 62 are formed in housing 28 adjacent interface rollers 52, 54 and 56, respectively.

A predetermined tension may be induced in outer film 36 and inner film 38 by controlling the rotation of the interface rollers 52, 54 and 56 in the manner described hereinafter. An individual currency note 18 may be passed through currency slot 64 in the cartridge 10 so that it contacts the outer and inner films 36 and 38 adjacent feed rollers 42 and 46. By rotating a supply spool 30 in the counterclockwise direction as shown in FIG. 2, the currency note will be sandwiched between outer and inner films 36 and 38 and wound upon the supply spool 30. As shown in FIG. 2, a large number of currency notes may be stored in this manner, each being individually sandwiched between segments of the outer and inner films 36 and 38. A supply spool 30 having a diameter of approximately twelve inches may hold up to 2,000 United States currency notes.

By rotating spool interface rollers 54 and 56 so that inner film takeup spool 32 and outer film takeup spool 34 are rotated in the clockwise and counterclockwise directions, respectively as shown in FIG. 2, outer and inner films 36 and 38 will be unrolled from supply spool 30 and onto the respective takeup spools 32 and 34. A currency note 18 sandwiched between the outer and inner films 36 and 38 will be urged toward currency slot 64. The currency note may be transported through the currency slot 64 by the action of films 36 and 38 to a mechanism described hereinafter.

The cartridge 10 forms a self contained unit for transporting currency notes stored within from one location to another in relative safety. During normal operation, the cartridge 10 need never be opened or unlocked so that the currency notes stored within could be removed by unauthorized personnel. The supply spool 30 could also be interlocked to prevent rotation of the spool in an unauthorized manner. In addition, cartridge 10 may be equipped with a mechanism which registers an attempt to open the cartridge or unroll currency notes therefrom in an unauthorized manner. A mechanical or electrical code key may be provided on cartridge 10 to indicate the denomination of the currency notes stored therein.

Figure 3:
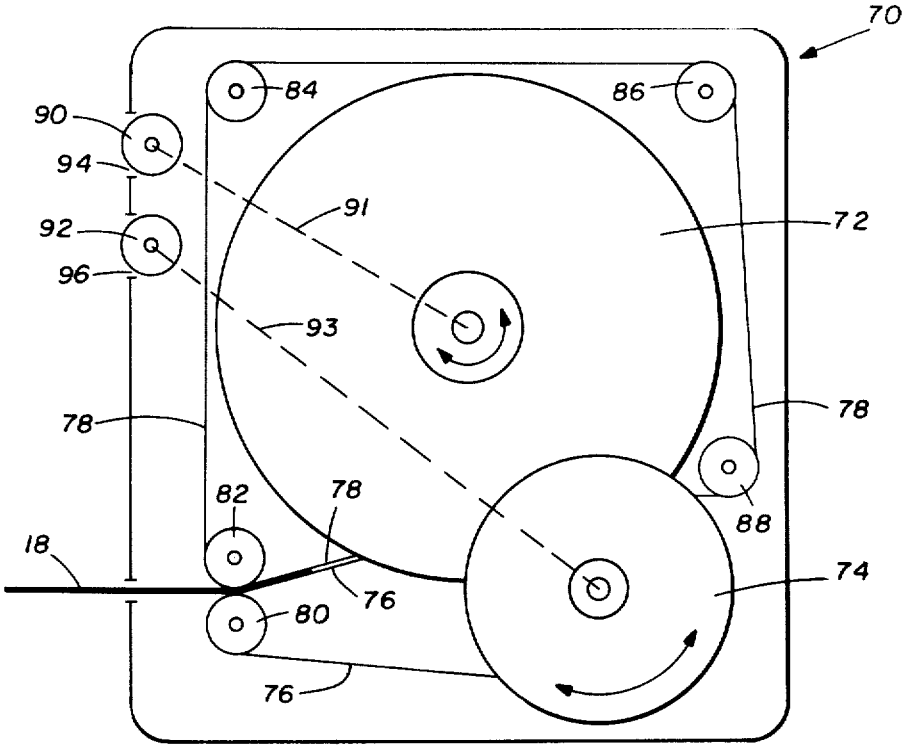
FIG. 3 is a sectional view of a first modification of the cartridge employed in the present invention.

FIG. 3 illustrates a first modification of the currency note cartridge indicated as cartridge 70. The cartridge 70 has a supply spool 72 and a takeup spool 74 rotatably mounted therein. An outer film 76 and inner film 78 are connected to and wrapped about the spools 72 and 74. Outer film 76 is threaded about a feed roller 80 between spools 72 and 74. Inner film 78 is threaded about a feed roller 82, idler roller 84, idler roller 86 and idler roller 88 between spools 72 and 74.

A supply spool interface roller 90 is mounted for rotation adjacent one side of cartridge 70 as shown.

Interface roller 90 is mechanically linked for rotation with supply spool 72. A takeup spool interface roller 92 is similarly rotatably mounted adjacent the side of cartridge 70 and is mechanically linked for rotation with takeup spool 74. Spool interface apertures 94 and 96 are provided in cartridge 70 adjacent interface rollers 90 and 92 respectively.

Cartridge 70 differs from the cartridge 10 shown in FIG. 2 in that it requires only one takeup spool to store the outer and inner film 76 and 78. Cartridge 70 therefore requires only two interface rollers 90 and 92. In addition, by interfacing the supply spool 72 and takeup spool 74, as by offsetting the rims, a larger diameter supply spool 72 may be used. In all other respects, the cartridge 70 is similar to cartridge 10.

Figure 4:
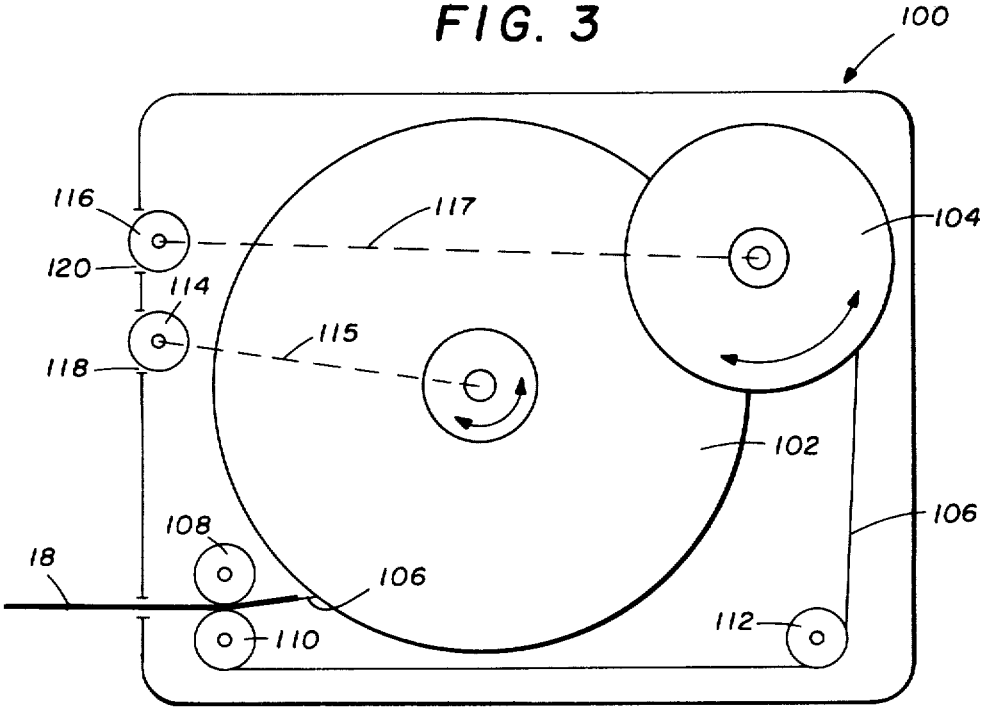
FIG. 4 is a sectional view of a second modification of the cartridge employed in the present invention.

FIG. 4 illustrates a second modification of the currency note cartridge indicated as cartridge 100. Cartridge 100 has a supply spool 102 and a takeup spool 104 rotatably mounted therein. A single film 106 is wrapped around and secured to spools 102 and 104 as shown. Film 106 passes feed roller 108 and is threaded about feed roller 110 and by idler roller 112 between spools 102 and 104. A supply spool interface roller 114 is rotatably mounted adjacent one side of cartridge 100 and mechanically linked for rotation with supply spool 102. A takeup spool interface roller 116 is rotatably mounted adjacent the side of cartridge 100 and mechanically linked for rotation with takeup spool 104. Spool interface apertures 118 and 120 are provided in cartridge 100 adjacent interface rollers 114 and 116, respectively. Cartridge 100 differs from cartridge 70 as shown in FIG. 3 only in the respect of employing a single film 106. The use of a single film eliminates the need to maintain equal tension on two films as required in the cartridges 10 and 70. However, the use of two films help control the currency notes, particularly when the supply spool is nearly empty.

Figure 5:
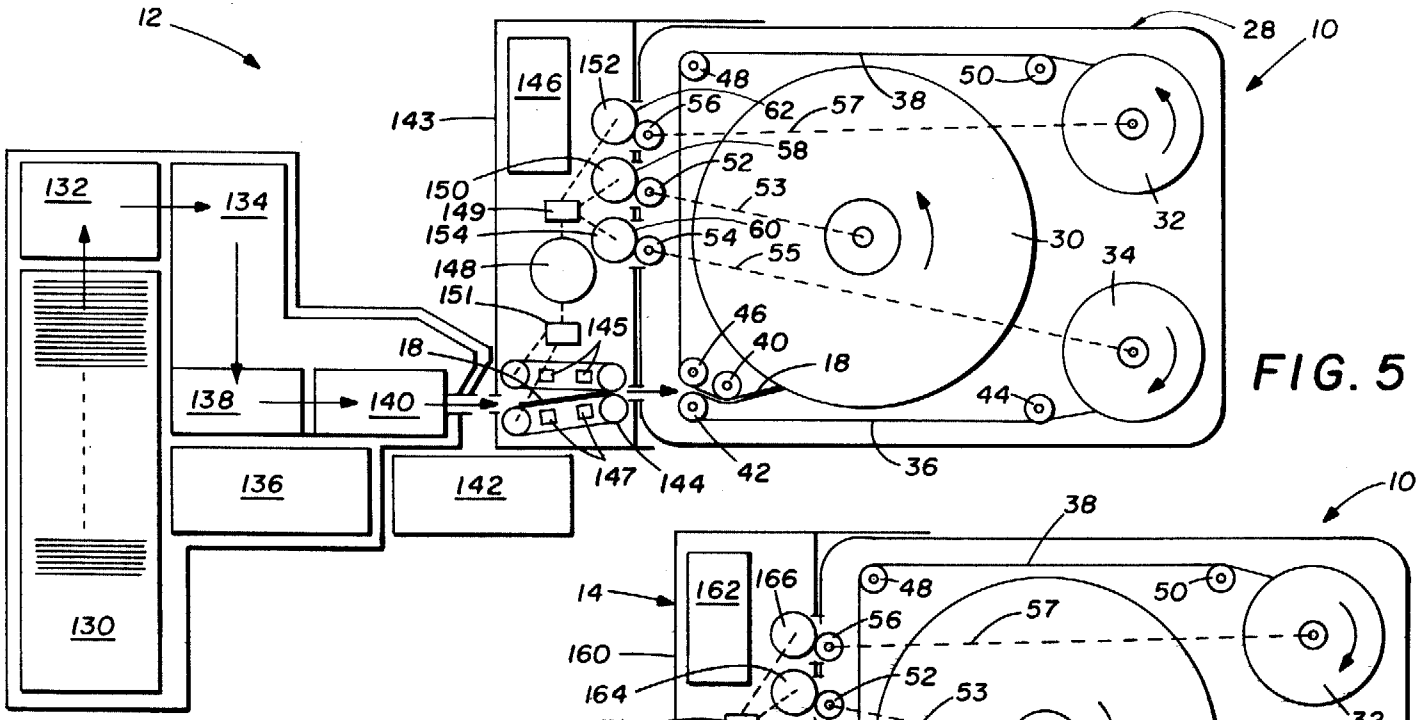
FIG. 5 is a sectional view of a loader and cartridge employed in the present invention.

FIG. 5 illustrates a cartridge 10 interconnected to a loader 12 for loading a predetermined number of currency notes into the cartridge. A stack of currency notes is placed within supply area 130 within loader 12. An internal mechanism keeps the stack of notes in contact with a picking mechanism 132. Individual currency notes are taken from the top of the stack by picking mechanism 132 and transported through a verification mechanism 134. The verification mechanism 134 is driven by a loader transport drive 136. Within verification mechanism 134 are a double detect separation station 138 and a diverter mechanism 140. The verification mechanism 134 acts to verify that each object transported through mechanism 134 is in fact an individual currency note. Mechanism 134 also acts to divert damaged or double currency notes into a storage bin 142. Individual undamaged currency notes are transported to transport 143.

Transport 143 includes a transport mechanism 144 which may be formed by belts traveling about rotatably mounted rollers. Optical sensors 145 in the transport mechanism 144 are activated by the presence of a currency note within mechanism 144 which prevents light from light sources 147 from entering the sensors 145. The sensors 145 relay this information to a controller 146. Controller 146 in turn activates variable speed motor 148 and further activates drive mechanisms 149 and 151. Motor 148 and drive mechanism 151 cooperate to drive transport mechanism 144 so that the currency note 18 is moved toward cartridge 10 as shown in FIG. 5. Motor 148 and drive mechanism 149 cooperate to drive supply interface drive roller 150 in a clockwise direction as shown in FIG. 5. Drive roller 150 extends to housing 28 at spool interface aperture 58 and is frictionally or otherwise coupled to interface roller 52. Drive roller 150 thereby causes supply spool 30 to rotate in the counterclockwise direction as shown in FIG. 5. Motor 148 and drive mechanism 149 also cooperate to supply a friction force acting against inner film interface drive roller 152 and outer film interface drive roller 154 extending to housing 28 at spool interface apertures 62 and 60 to resist rotation of rollers 152 and 154. Rollers 152 and 154 are frictionally or otherwise coupled to spool interface rollers 56 and 54, respectively. Drive rollers 152 and 154 thereby resist rotation of inner and outer film spools 32 and 34 within cartridge 10 to maintain tension on the outer and inner films 36 and 38. The individual currency note 18 is transported through the transport mechanism 144 and is driven between feed rollers 42 and 46. This action allows the outer and inner films 36 and 38 to sandwich the currency note therebetween as the films and currency note are rolled onto supply spool 30. The trailing edge of the currency note 18 passing through transport mechanism 144 acts as a signal to controller 146 which may be used to count the number of currency notes loaded into cartridge 10 and initiate another cycle of picking, verifying, transporting and rolling up a currency note in the supply spool.

The loader 12 may be located in a bank vault or in a secure back room of a bank or other financial office so that the operation of loading currency notes within a cartridge 10 is done in a secure location. The second embodiment of the system contemplates the use of a number of remote dispensers 14 supplied with loaded cartridges 10 that are loaded by a single loader 12. The complexity of loader 12 causes the loader to be quite expensive. In this system, the cost of the loader may be distributed across a number of the relatively cheaper dispensers 14 and thereby reduce the total cost for each working dispenser in the system. Any denomination of currency notes may be loaded into a cartridge 10 by loader 12. The loader 12 may also set the code key on cartridge 10 to indicate the denomination loaded therein.

Figure 6:
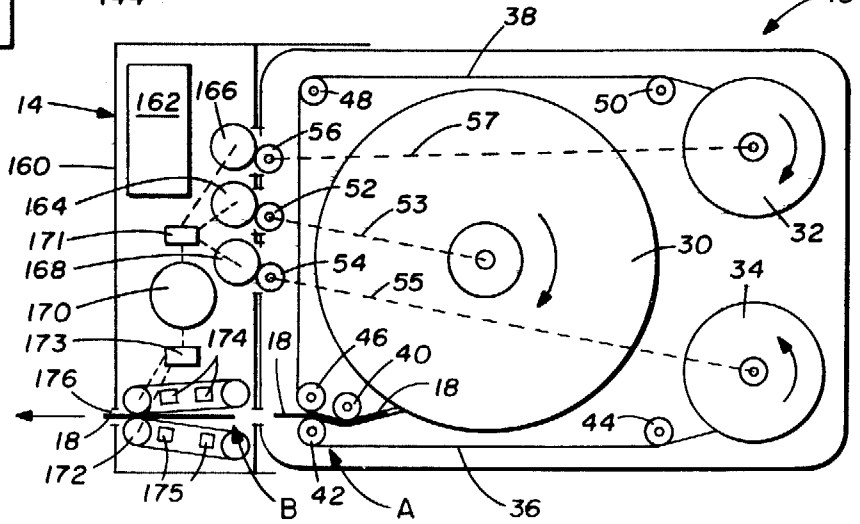
FIG. 6 is a sectional view of a dispenser and cartridge employed in the present invention.

FIG. 6 illustrates the first embodiment of the dispensing system which includes a cartridge 10 interconnected with a dispenser 14. It is also clear FIG. 6 illustrates a portion of the second embodiment of the dispensing system. In this second embodiment, the dispenser 14 may be located at a substantial distance from loader 12. A cartridge 10 loaded with currency notes may be transported from loader 12 to the dispenser 14. The structure of cartridge 10 as described hereinabove insures the security of the currency notes therein during transport.

It can be readily seen that dispenser 14 has a substantial similarity in structure and function to transport 143 shown in FIG. 5. In fact, the same unit may be employed in both respects with only minor modifications in the transport mechanism to accommodate transport of currency notes in opposite directions, thereby reducing the total cost of the system by standardizing the components. Cartridge 10 is adapted to be used with both loader 12 and any dispenser 14, thereby also acting to standardize the components within both embodiments of the system.

Dispenser 14 is provided with a housing 160. Housing 160, or an additional facing plate not shown, may form the exposed structure of an ATM which is located at a convenient location for the use of customers. The individual customer may enter a coded token or personal identification number into the ATM which activates the controller 162. When the cartridge 10 is mechanically mated with dispenser 14, the interface rollers 52, 54 and 56 are frictionally or otherwise coupled to supply interface drive roller 164, outer film interface drive roller 168 and inner film interface drive roller 166, respectively. The controller 162 activates a variable speed motor 170 and drive mechanism 171 to rotate spool interface rollers 54 and 56 in the counterclockwise and clockwise directions, respectively as noted in FIG. 6. This rotation induces similar rotation in inner and outer film takeup spools 32 and 34 which causes outer and inner films 36 and 38 to be unwrapped from supply spool 30 to present a currency note 18 past position A as shown in FIG. 6 through currency slot 64 and into transport mechanism 172 at position B. Motor 170 and drive mechanism 171 further interact to apply a braking force to resist rotation of supply interface drive roller 164, thereby resisting rotation of supply spool 30 and maintaining tension on outer and inner films 36 and 38. Light sources 175 interact with optical sensors 174 to sense the presence of a currency note 18 within mechanism 172. The optical sensors 174 signal to controller 162 that a currency note 18 is present within the mechanism 172. Controller 162 activates motor 170 and drive mechanism 173 which cooperate to activate the transport mechanism 172 so that a currency note located within mechanism 172 is transported away from cartridge 10 as shown in FIG. 6. The controller 162 verifies the passage of the currency note, counts the number of currency notes dispensed and reports to the customer operated controls of the ATM as required. The transport mechanism 172 transports the currency note 18 out through aperture 176 to a position where the customer can accept the note. The controller 162 continues to activate motor 170 and drive mechanisms 171 and 173 until the proper number of currency notes have been delivered through aperture 176.

When the controller 162 is first activated by a customer, optical sensors 174 immediately verify the presence or absence of a currency note within mechanism 172. Optical sensors 174 continue to constantly monitor the travel of currency notes through mechanism 172 during the entire dispensing cycle. If so desired, an internal counter may be provided within cartridge 10 to provide a means to check the count obtained by optical sensors 174.

A series of dispensers 14 may be placed side by side within an ATM and provided with cartridges 10 having varied denominations therein. In this manner, the ATM will have great flexibility in providing a desired amount of currency to the customer. The code key on the cartridge 10 will indicate to controller 162 the denomination of the particular currency notes within the cartridge. If desired the operation of dispenser 14 may be reversed. The dispenser may then be used to load customer entered currency notes or other items into a cartridge. This reverse operation would require only a minor modification in transport mechanism 172 to accommodate transport in the opposite direction. It is clear the system of the present invention may also be used with teller windows or in a point of sale device in addition to its use in an ATM.

The two embodiments of the system described hereinabove provide a relatively low cost and high reliability method for dispensing currency notes. In the second embodiment, the system centralizes the difficult, complex and expensive job of separating and verifying individual currency notes of varying quality into a centrally located loader. A number of remote dispensers are provided which perform the relatively simple and inexpensive task of counting and dispensing individual currency notes. The self contained cartridge may be interchangeably connected with both the loader and dispenser. The loader acts to load a predetermined number of currency notes into the cartridge. The cartridge may then be transported to a remote dispenser in a secure and convenient manner. The dispenser the functions to dispense the individual currency notes from the loaded cartridge.

While only two embodiments of the present invention have been described in detail herein and shown in the accompanying drawings, it will be evident that various further modifications are possible without departing from the scope of the invention.

I claim:

1. A system for dispensing currency notes, comprising:

a cartridge for receiving a predetermined number of currency notes, comprising a housing, a supply spool mounted for rotation therein, at least one takeup spool mounted for rotation therein and at least one film secured at opposite ends to said supply spool and said takeup spool and wound about said spool, means for interlocking said housing and said supply spool to prevent unauthorized dispensing of currency notes from the cartridge, and means to detect unauthorized operations of said cartridge;

a loader for accepting a quantity of currency notes and loading the predetermined number of currency notes individually into said cartridge;

a dispenser for dispensing currency notes individually from said cartridge; and said cartridge being adapted for use selectively with both said loader and said dispenser and being transferrable from said loader to said dispenser.

2. The system of claim 1 wherein said loader comprises:

means for separating individual currency notes from a stack of currency notes;

means for verifying the separation of individual currency notes; and means for transporting the individual currency notes to said cartridge and loading the individual currency notes into said cartridge.

3. The system of claim 1 wherein said dispenser comprises:

means for activating said cartridge to transfer a currency note from said cartridge into said dispenser;

a transport mechanism for transporting the currency note through said dispenser to a customer receiving area;

means for sensing the presence of a currency note within said dispenser and verifying passage of the currency note through said dispenser; and means for controlling said activating means and said transport mechanism to dispense a preselected number of currency notes to the customer receiving area.

4. A system for dispensing currency notes, comprising:

a cartridge for receiving a predetermined number of currency notes;

a loader for accepting a quantity of currency notes and loading the predetermined number of such notes individually into said cartridge;

a dispenser for dispensing currency notes individually from said cartridge, said dispenser including means for activating said cartridge to transfer a currency note therefrom into the dispenser, a transport mechanism for transporting the currency note through the dispenser to a customer receiving area, means for sensing the presence of a currency note in the dispenser and verifying passage thereof through the transport mechanism, and means for controlling said activating means and said transport mechanism to dispense a preselected number of currency notes to a customer receiving area.

5. The system of claim 4 or 1 wherein said cartridge further has a code key to indicate to said dispenser the denomination of the currency notes loaded therein.

6. A system for dispensing currency notes, comprising:

a cartridge for receiving a predetermined number of currency notes;

a loader for accepting a quantity of currency notes and loading the predetermined number of currency notes individually into said cartridge, said loader including means for separating individual currency notes from a stack of such notes, means for verifying the separation of individual currency notes, and means for transporting the individual currency notes to said cartridge for loading therein;

a dispenser for dispensing currency notes individually from said cartridge; and said cartridge being adapted for use selectively with both said loader and said dispenser and being transferrable from said loader to said dispenser.

7. The system of claim 6 or 1 wherein said verifying means further comprises means for diverting damaged and doubled currency notes.

8. The system of claim 6 or 1 wherein said transporting means further comprises means for counting the individual currency notes loaded into said cartridge.

9. The system of claim 6 or 4 wherein said cartridge comprises:

a supply spool mounted for rotation within said cartridge;

at least one takeup spool mounted for rotation within said cartridge;

at least one film secured at opposite ends to said supply spool and said takeup spool and wound about said spools; and the individual currency notes loaded into said cartridge being placed on said film and wound about said supply spool for storage.

10. The system of claim 9 wherein said cartridge further comprises means for interlocking said cartridge and said supply spool to prevent unauthorized rotation of said supply spool and means to detect an unauthorized attempt to remove the currency notes from said cartridge.

11. The system of claim 6, 4 or 1 wherein said cartridge further comprises:

a first takeup spool;

a second takeup spool;

an inner film secured to said first takeup spool and said supply spool and wound on said spools;

an outer film secured to said second takeup spool and said supply spool and wound on said spools; and the individual currency bills loaded into said cartridge being sandwiched between said inner and said outer film when wound on said supply spool.

12. The system of claim 6, 4 or 1 wherein said loader includes means for rotating said supply spool to wind said film and the individual currency notes on said supply spool and means for resisting the rotation of said takeup spool to maintain a preselected tension on said film.

13. The system of claim 6, 4, or 1 wherein said dispenser includes means for rotating said takeup spool to unwind said film from said supply spool and present a currency note stored within said cartridge to said dispenser and means for resisting the rotation of said supply spool to maintain a preselected tension on said film.

14. A system for dispensing currency notes comprising:

a cartridge for receiving a predetermined number of individual currency notes comprising a housing, a supply spool mounted for rotation therein, at least one takeup spool mounted for rotation therein and at least one film secured at opposite ends to said supply spool and said takeup spool and wound about said spools, means for interlocking said housing and said supply spool to prevent unauthorized dispensing of currency notes therefrom, and means to detect unauthorized operations of said cartridge, the individual currency notes being received in said cartridge, placed on said film and wound about said supply spool for storage; and a dispenser for dispensing currency notes individually from said cartridge and comprising means for rotating said takeup spool to unwind said film from said supply spool and present a currency note stored within said cartridge to said dispenser, means for resisting the rotation of said supply spool to maintain a preselected tension on said film, a transport mechanism for transporting the currency note through said dispenser to a customer receiving area, means for sensing the presence of a currency note within said dispenser and verifying passage of the currency note through said dispenser and means for controlling said rotating means, said resisting means and said transport mechanism to dispense a preselected number of currency notes to the customer receiving area.

15. An individual currency note dispensing system comprising:

a cartridge for storing a predetermined number of currency notes in a discrete manner comprising a housing, a supply spool rotatably mounted in said housing, a takeup spool rotatably mounted in said housing, a flexible film secured at its ends to said supply spool and said takeup spool and wound about said spools and means to guide said film between said supply spool and said takeup spool, means for interlocking said housing and said supply spool to prevent unauthorized dispensing of currency notes therefrom, and means to detect unauthorized operations of said cartridge, the individual currency notes being stored on said film wound on said supply spool; and a dispenser for dispensing individual currency notes from said cartridge comprising means to rotate said takeup spool to withdraw an individual currency note from said cartridge, means to resist the rotation of said supply spool to maintain tension in said film, a transport mechanism to receive the withdrawn currency note and transport the currency note to a customer receiving area, means to sense the presence of a currency note within said transport mechanism and verify passage of the currency note therethrough and means to activate said rotating means, said resisting means, said transport mechanism and said sensing means in response to a request to dispense an individual currency note.

16. An individual currency note dispensing system comprising:

a cartridge for storing a predetermined number of currency notes in a discrete manner comprising a housing, a supply spool rotatably mounted in said housing, a takeup spool rotatably mounted in said housing, an inner flexible film secured at its ends to said supply spool and said takeup spool and wound about said spools, an outer flexible film secured at its ends to said supply spool and said takeup spool and wound about said spools and means to guide said inner and outer flexible films between said supply spool and said takeup spool, means for interlocking said housing and said supply spool to prevent unauthorized dispensing of currency notes therefrom, and means to detect unauthorized operations of said cartridge, the individual currency notes being stored between said inner and outer flexible films when wound on said supply spool; and a dispenser for dispensing individual currency notes from said cartridge comprising means to rotate said takeup spool to withdraw an individual currency note from said cartridge, means to resist the rotation of said supply spool to maintain tension in said inner and outer flexible films, a transport mechanism to receive the withdrawn currency note and transport the currency note to a customer receiving area, means to sense the presence of a currency note within said transport mechanism and verify passage of the currency note therethrough and means to activate said rotating means, said resisting means, said transport mechanism and said sensing means in response to a request to dispense an individual currency note.

17. An individual currency note dispensing system comprising:

a cartridge for storing a predetermined number of currency notes in a discrete manner comprising a housing, a supply spool rotatably mounted in said housing, a first takeup spool rotatably mounted in said housing, a second takeup spool rotatably mounted in said housing, an inner flexible film secured at its ends to said supply spool and said first takeup spool and wound about said spools, an outer flexible film secured at its ends to said supply spool and said second takeup spool and wound about said spools and means to guide said inner and outer flexible films between said supply spool and said takeup spools, means for interlocking said housing and said supply spool to prevent unauthorized dispensing of currency notes therefrom, and means to detect unauthorized operations of said cartridge, the individual currency notes being stored between said inner and outer flexible films when wound on said supply spool; and a dispenser for dispensing individual currency notes from said cartridge comprising means to rotate said takeup spools to withdraw an individual currency note from said cartridge, means to resist the rotation of said supply spool to maintain tension in said inner and outer flexible films, a transport mechanism to receive the withdrawn currency note and transport the currency note to a customer receiving area, means to sense the presence of a currency note within said transport mechanism and verify passage of the currency note therethrough and means to activate said rotating means, said resisting means, said transport mechanism and said sensing means in response to a request to dispense an individual currency note.

18. A currency note dispensing system comprising:

at least one cartridge for storing a predetermined number of currency notes in a discrete manner, said cartridge comprising a housing, a supply spool rotatably mounted in said housing, at least one takeup spool rotatably mounted in said housing, at least one flexible film secured at its ends to said supply spool and said takeup spool and wound about said spools and means to guide said film between said supply spool and said takeup spool, the currency notes being stored on said film wound on said supply spool;

a loader for accepting a stack of currency notes, separating the stack into individual currency notes and loading the predetermined number of currency notes into said cartridge, said loader comprising a supply area containing the stack of currency notes, a picking mechanism for removing individual currency notes from said supply area, means for verifying the removal of individual currency notes and a transport for transporting individual currency notes to said cartridge and loading the currency note into said cartridge by rotating said supply spool;

at least one dispenser for dispensing individual currency notes from said cartridge, said dispenser comprising a transport for rotating said takeup spool to present an individual currency note to said dispenser from said cartridge and for transporting the currency note from said cartridge to a customer receiving area and means to activate said transport to dispense a preselected number of currency notes;

said transport in said loader and said transport in said dispenser each comprising a transport mechanism for transporting the currency note, means for sensing the presence of a currency note within the transport mechanism and verifying passage of the currency note therethrough, means to induce rotation in one of said spools and resist rotation of the other spool to maintain tension in said film and means for controlling said activating means and said transport mechanism; and said cartridge being interchangeably connected to the transport in said loader and said dispenser, said cartridge being transferable from said loader to said dispenser permitting said loader and said dispenser to be at remote locations and permitting a single loader to provide loaded cartridges to a number of dispensers.

19. The system of claim 18 wherein said cartridge further comprises a key code for indicating the denomination of the currency notes within.

20. The system of claim 18 wherein said cartridge further comprises means to interlock said housing and said supply spool to prevent unauthorized dispensing of currency notes therefrom and means to detect unauthorized operations on said cartridge.

21. The system of claim 18 wherein said cartridge further comprises:

an inner flexible film;

an outer flexible film;

at least one takeup spool, said inner and outer flexible films being secured at one end to said supply spool and at their opposite ends to said takeup spool and wound on said spools; and the individual currency notes being sandwiched between said inner and outer flexible films when wound on said supply spool.

22. The system of claim 18 wherein said means for verifying the removal of individual currency notes further comprises means for diverting damaged and doubled currency notes.

23. The system of claim 18 wherein said transport in said loader and said transport in said dispenser each further comprises means for counting the individual currency notes passing therethrough.

* * * * *